US006054644A

United States Patent [19]

Allen et al.

[11] Patent Number: 6,054,644

[45] Date of Patent: Apr. 25, 2000

[54] INTERCHANGEABLE BORE CLARINET BARREL SYSTEM

[76] Inventors: Rheuben A. Allen, 5503 Hermitage Ave., #B, Valley Village, Calif. 91607; Robert D. Malone, 4433 Deanwood Dr., Woodland Hills, Calif. 91364

[21] Appl. No.: 09/192,984

[22] Filed: Nov. 16, 1998

Related U.S. Application Data

[60] Provisional application No. 60/065,485, Nov. 19, 1997.

[51] Int. Cl.[7] ..... G10D 7/06

[52] U.S. Cl. ..... 84/382; 84/380 R; 84/394

[58] Field of Search ..... 84/382, 383 R, 84/380 R, 394, 398, 399

[56] References Cited

U.S. PATENT DOCUMENTS 3,722,348 3/1973 Visser .
4,258,605 3/1981 Lorenzini .
4,852,446 8/1989 Kennedy .
5,291,817 3/1994 Smith .

*Primary Examiner*—Brian Sircus
*Assistant Examiner*—Shih-yung Hsieh
*Attorney, Agent, or Firm*—Kelly Bauersfeld Lowry & Kelley, LLP

[57] ABSTRACT

A interchangeable bore clarinet barrel system is provided which eliminates the need for substituting one clarinet barrel for another in order to change tone color, intonation, and response characteristics. The barrel system is attachable to adjacent portions of a clarinet and includes a barrel body and a bore removably attached to the body. The body may be in two sections, or a single-piece unitary barrel body. The bore may be frictionally fitted or threadedly received into the barrel body. Tone rings and sleeves allow alteration of the tone color, intonation and response characteristics of the clarinet.

17 Claims, 5 Drawing Sheets

FIG. 1
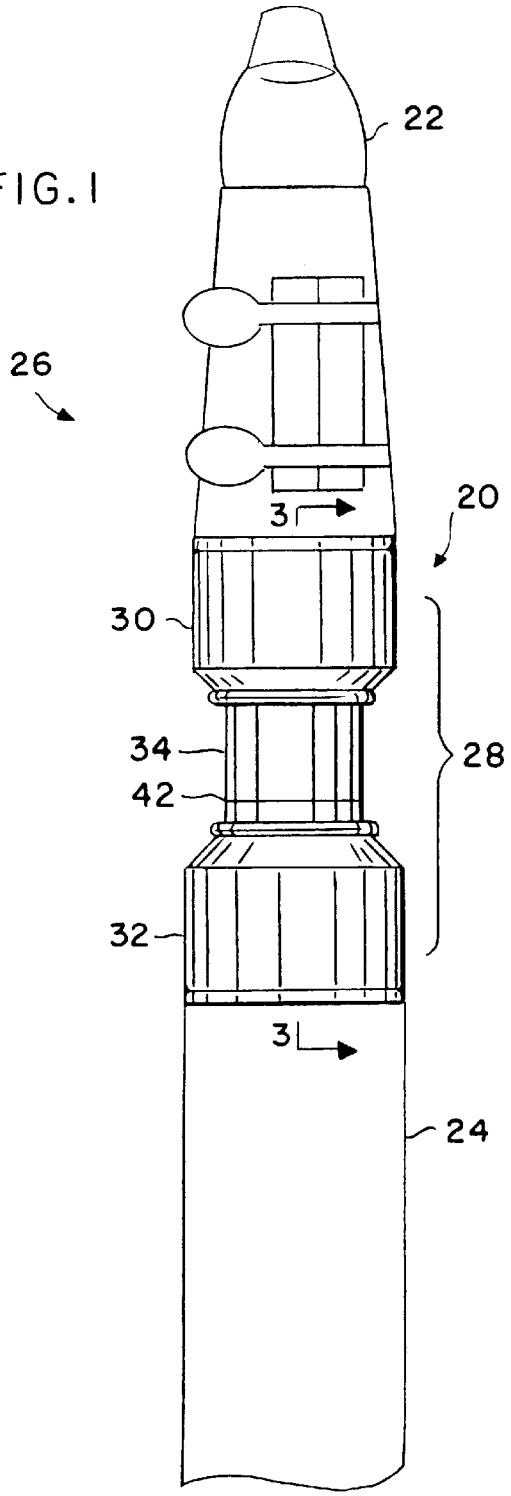
FIG. 2
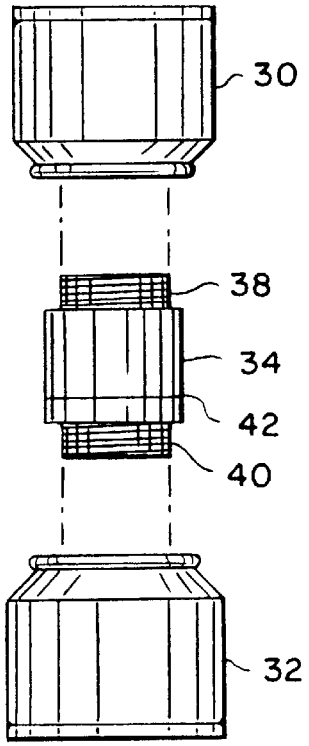
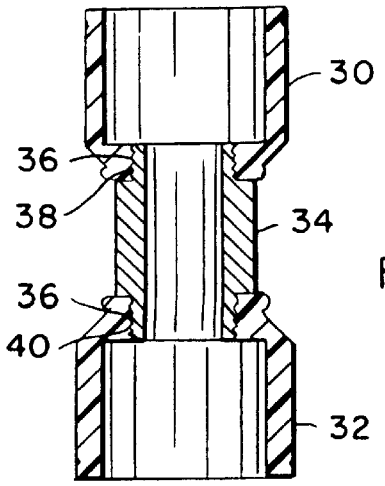
FIG. 3

FIG.4
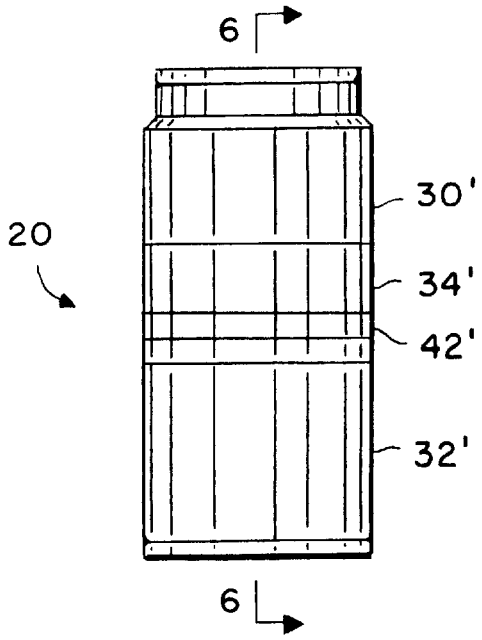
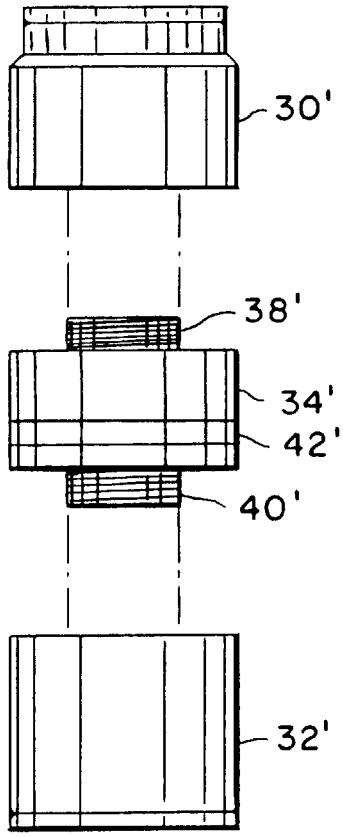
FIG.5
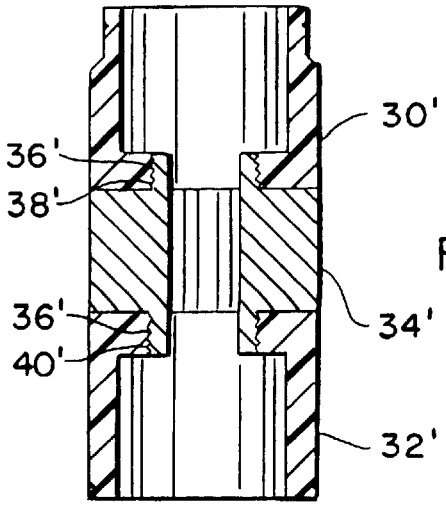
FIG.6

FIG. 7
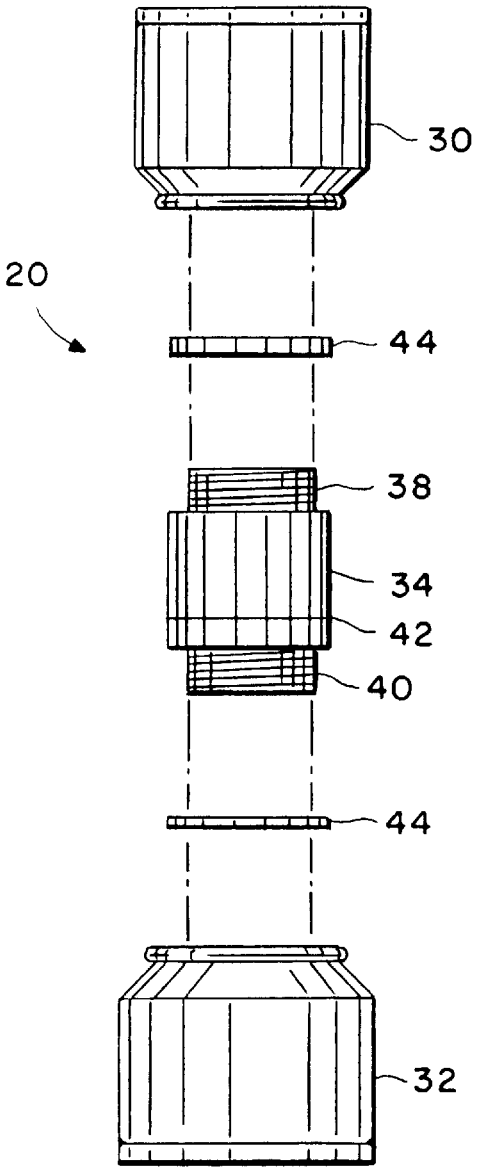
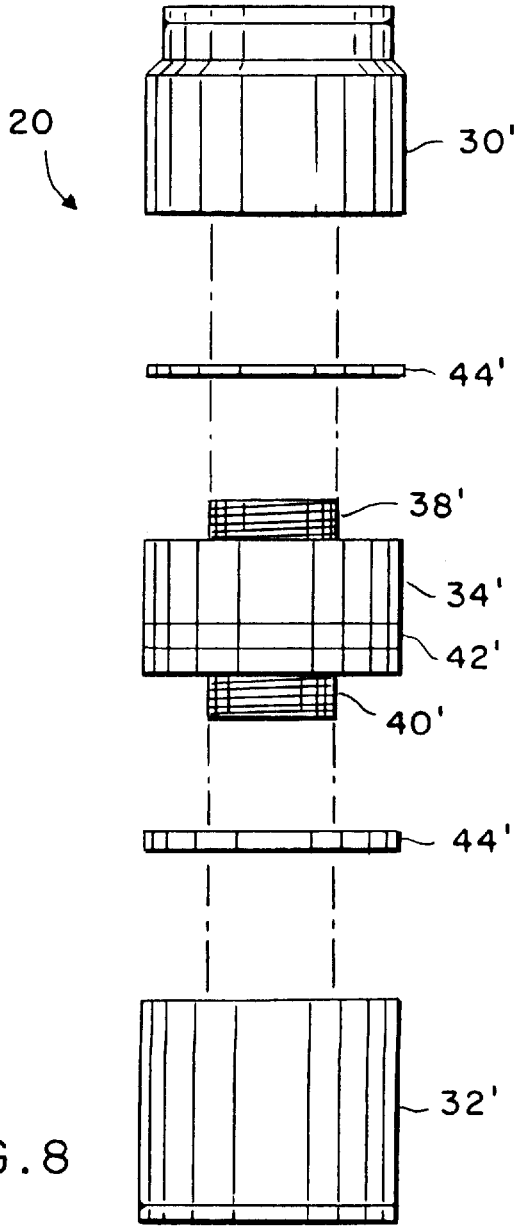
FIG. 8

INTERCHANGEABLE BORE CLARINET BARREL SYSTEM

RELATED APPLICATION

This application claims priority from provisional application number 60/065,485 filed Nov. 19, 1997.

BACKGROUND OF THE INVENTION

This invention relates generally to improvements in musical instruments, particularly to clarinets. More specifically, the present invention relates to an improved barrel assembly of a clarinet having a removable and interchangeable bore wherein intonation, response, and tone color can be modified without the need of replacing the entire barrel assembly.

The clarinet is a member of the woodwind family. Woodwinds are instruments that produce their sound or tone by a vibrating reed. The earliest record of the clarinet is in J. G. Doppelmayr's Historische Nachricht von den Nurnbergischen Mathematics und Kunstlern (Nuremberg 1730), with its biography of maker Johann Christoph Denner (1655–1707).

The clarinet used mostly in the United States is called a plain Bohem clarinet. This instrument was devised by clarinetist Hyacinthe Klose with clarinet maker Auguste Buffet Jeune, and was first exhibited in 1843. Some of the other systems are the full Bohem clarinet (this system offers many more combinations for fingering notes making many passages easier to play, and is also longer which produces a darker tone color), the Albert clarinet (a simple system), and the Oehler system used in Germany and Europe.

One of the differences between the Albert system clarinet and the Bohem system clarinet is that on the Albert when you use the first finger of the right hand you will produce a low B-natural and a middle F-sharp, whereas the Bohem clarinet will produce a low B-flat and a middle F-natural when using this same fingering. The Albert system is also simpler than the Bohem system in that it often only has one way to finger a given note or tone.

There are also differences between the plain Bohem clarinet and the full Bohem clarinet. There is a sixth ring on the full Bohem under the third finger of the left hand. This ring allows an alternate fingering for the low E-flat and upper B-flat by picking up the third finger of the left hand which is much faster than the fingering on the plain Bohem system clarinet. There is an alternate left hand A-flat/E-flat key making many finger combinations much easier and smoother to play. There is what is called an articulated G-sharp mechanism. This mechanism allows the player to hold down the G-sharp key when playing hard or fast passages going to F-sharp, D-sharp and any other note, making these passages much easier and smoother. The full Bohem is also capable of an extra half step or semi-tone lower than the plain Bohem. This half step is produced because the full Bohem clarinet is longer than the plain Bohem clarinet. This length allows the production of a low E-flat and a middle B-flat with a long fingering. However, the most important aspect the extension and extra semi-tone is that a vent is provided for the middle B-natural to speak from, responding quicker than the middle B-natural on the plain Bohem clarinet.

The clarinet is widely used in all forms of present day music. In the orchestra as a stable in the woodwind section, in traditional jazz, modern jazz, and in the concert band replacing the voices of the string section of the orchestra. The first clarinetist is the concert master of the concert band.

The clarinet comes in several basic keys including B-flat used in orchestra, concert bands and jazz, the A used mostly in the orchestras, E-flat soprano, C soprano, B-flat bass, E-flat contra alto, and B-flat contra bass.

The traditional clarinet is basically made in five pieces. The mouthpiece, barrel, upper joint, lower joint and the bell section. There are some exceptions to this rule. There have been clarinets made with the upper and lower joints as a single piece. This clarinet has four pieces. Most metal clarinets used in the 1920's and 1930's were made with the upper joint, lower joint and bell as one section. This clarinet has only three pieces.

The barrel and mouthpiece are considered by many of the world's greatest clarinetists to be the most important parts of the clarinet. The barrel controls the intonation (pitch), tone color (type of sound) and response (the amount of time it take for a note or sound to come out of the instrument after a key or mechanism has been moved from one note to another) of the clarinet.

Both the barrel and mouthpiece of the clarinet are held to the instrument by a ring of cork. The fit of this cork is very important. If the cork is loose the mouthpiece or the barrel may move making it difficult to play the instrument properly or causing a leak in the instrument which results in poor response. The fit of the barrel to both the mouthpiece and clarinet upper joint is very difficult to maintain when changing several barrels. If one places a barrel on the cork that is slightly smaller than the one used prior to it, the smaller barrel will tend to compress the cork. Then when returning to the original barrel the fit will be slightly loose. This again creates both intonation and response problems. It has been very difficult to control the cork fit on both the barrel and mouthpiece when it is necessary to change the complete barrel to either alter intonation and/or tone color (sound). The need to carry several barrels to insure having the proper barrel for each performance is quite a concern to the player.

Another difficulty experienced with past clarinets arose when a player wanted to use the same barrel when switching instruments. Generally, the mouthpieces made in the United States are close to the same bore size, however, the bores of the various clarinets are different. This creates problems for the player in being able to use the same barrel when switching from one instrument to another.

The bore, the central passageway through the barrel, controls the tone color and response of the clarinet. Traditionally, the bore of the clarinet is basically a cylinder that may be slightly tapered. With the traditional clarinet barrel it is necessary to change the entire barrel to change the bore taper of the clarinet. For example, if the clarinet player wants a traditional bore (cylinder) it must come in one barrel, but if the clarinet player wants a barrel that has a reverse taper, or any other taper, he must choose a different barrel.

Accordingly, there is a need for a clarinet barrel system which eliminates the need to carry multiple barrels, maintains the cork fit, and allows a mouthpiece from one clarinet to be used on the body of another. This must be accomplished without impairing the response, articulation, intonation, and tone control of the instrument. The present invention fulfills these needs and provides other related advantages.

SUMMARY OF THE INVENTION

The present invention resides in an interchangeable barrel system for a clarinet. This system is unique in that the bore may be removed and interchanged while retaining key components of the original barrel. This allows the clarinet player to select from a variety of bores with varying tapers, material compositions, and dimensions while maintaining the barrel's fit with adjacent components of the clarinet.

The interchangeable bore clarinet barrel system of the present invention comprises, generally, a removable bore connected to a barrel body by either compressibly fitting the bore within the inner surface of the body, or screwing threaded portions of the bore and barrel body together. The bore has a selected taper, including cylindrical, reverse, cone, hourglass, or flair shaped tapers, and may be threaded at both ends for attachment to separate upper and lower sections of the body. For identification purposes the bore may be marked with one or more identification rings.

In one preferred form of the invention, the barrel body has an upper and a lower section, each having an inner surface which comprises threaded and non-threaded portions. The non-threaded portion of the upper section is detachably connected to the mouthpiece, and the non-threaded portion of the lower section is detachably connected to the lower joint of the clarinet. A removable bore threadedly engages the threaded portion of the upper section of the body and the threaded portion of the lower section of the body. The bore may thus be removed from the barrel system by simply unscrewing it from the upper and lower sections of the body.

The removable bore has a taper which may be shaped as an hourglass, flair, cylindrical, reverse or a cone. The clarinet barrel system of the present invention allows one bore to have both reverse and cone tapers by merely inverting, or turning over, the bore in the assembled barrel system. The bore's outer surface may be surrounded by a tone sleeve that may be solid, or contain rounded or slotted holes for vibration. A tuning ring may be disposed between the bore and an adjacent section of the barrel body.

In another embodiment of the invention, the barrel system comprises a unitary barrel body and a removable bore connected thereto. This connection is accomplished either by means of threadedly attaching or by frictionally fitting the bore into an inner surface of the barrel body. When the bore is frictionally fitted into the inner surface of the body, a flange on the upper end of the bore contacts an inner shoulder within the surface of the barrel body, preventing the passage of the bore through the body.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an elevational view of an interchangeable bore clarinet barrel system embodying the invention, shown connected to a mouthpiece and an upper joint of an exemplary clarinet;

FIG. 2 is an exploded elevational view of the barrel system of FIG. 1, illustrating the component parts thereof;

FIG. 3 is a sectional view taken generally along line 3—3 of FIG. 1, illustrating a bore threadedly connected to upper and lower sections of a barrel body;

FIG. 4 is an elevational view of a second embodiment of the barrel system;

FIG. 5 is an exploded elevational view of the barrel system of FIG. 4, illustrating the component parts thereof;

FIG. 6 is a sectional view taken generally along the line 6—6 of FIG. 4, illustrating a bore threadedly connected to upper and lower sections of the barrel body;

FIG. 7 is an exploded elevational view of the barrel system of FIGS. 1–3 illustrating tone rings disposed between the bore and the upper and lower barrel body sections;

FIG. 8 is an exploded elevational view of the barrel system of FIGS. 4–6, illustrating tone rings disposed between the bore and the upper and lower barrel body sections;

DETAILED DESCRIPTION OF THE PREFERRED EMBODIMENTS

Figure 9:
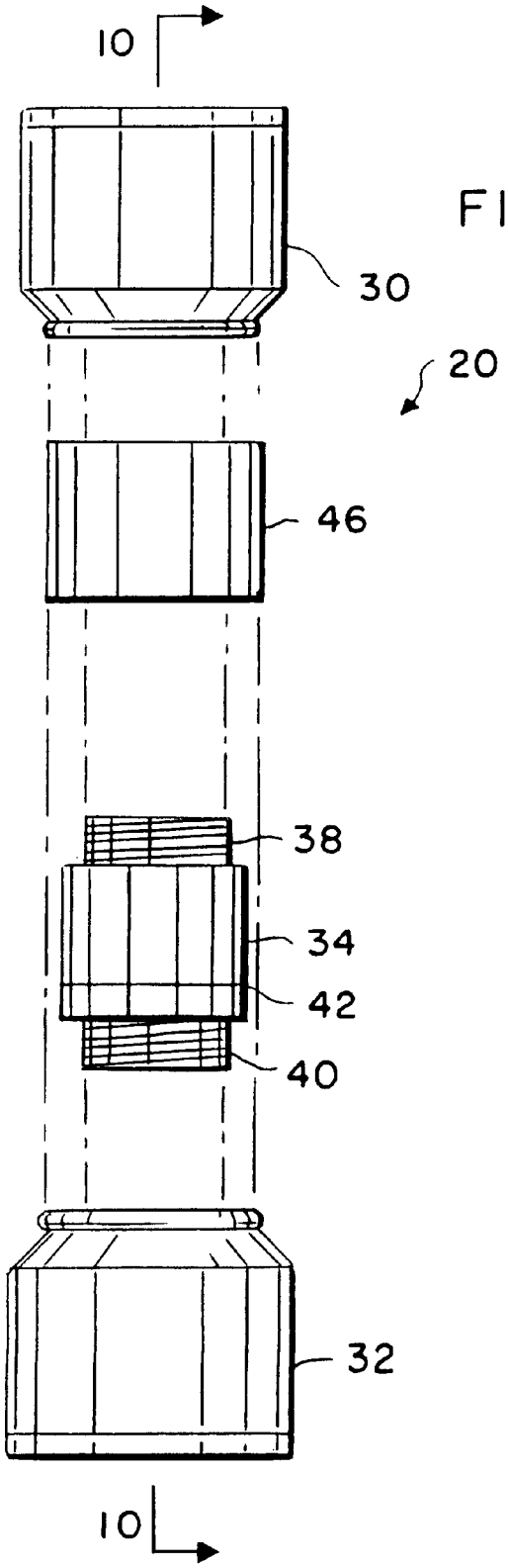
FIG. 9 is an exploded elevational view of the barrel system of FIGS. 1–3, illustrating a tone sleeve surrounding the bore and disposed between the upper and lower body sections.

As shown in the drawings for purposes of illustration, the present invention is concerned with an interchangeable bore clarinet barrel system, generally designated by the reference number 20. As shown in FIG. 1, the barrel system 20 is typically interconnected between a mouthpiece 22 and an upper joint 24 of a clarinet 26. The interchangeable bore clarinet barrel system 20 of the present invention offers several advantages to clarinetists which have not been available before in traditional barrels.

In order to appreciate these advantages, the reader should understand that the barrel of the clarinet 26 is the piece which fits between the mouthpiece 22 and the upper joint 24 of the clarinet 26. The barrel is used to control: intonation by changing the barrel length; the type of tone color or sound; and the response by using different tapers in the barrel of the clarinet. Wood has been considered by many fine clarinetists to be the best material for barrels as it produces the best tone color, however, wood tends to change with weather or age creating both response and intonation problems. Plastic, hard rubber, and Delrin have been used in the manufacture of the clarinet mouthpiece with a great deal of success. Their vibration and tone color characteristics transfer well to the barrel section. Barrel sections have also been manufactured using these materials, but only one material at a time. With the use of the present invention it is possible to use more than one material at a time, producing many different tone colors. Likewise, brass and other metals have not been used in the past extensively in the manufacture of clarinet barrels due to their heavy weight. The present invention, however, now permits use of these metals as well as glass and other materials.

In the past instruments other than clarinets, such as trumpets and saxophones, have been subjected to processes such as heat treatment to change the tone color of the instrument. As metal and other materials are now used with the present invention, these materials can be subjected to these processes to alter their qualities for the same beneficial effects in clarinets. For example, the tone color of brass can be altered by either a heat process, a cold process, or a heat and cold process. This results in four different tone color choices for brass alone. Annealing, a process which expands the grain of the material resulting in a warmer and very quick response, and other processes may be applied to a number of materials and metals used in the interchangeable bore clarinet barrel system 20. Moreover, plating the different metal bore sections also changes the bore response, tone color, and resistance. A brass piece may be silver or gold plated, or even plated by both. Each plating adds its own personality to the bore section.

The traditional clarinet barrel comes in six lengths (63 mm, 64 mm, 65 mm, 66 mm, 67 mm, and 68 mm). Pitch is altered by changing the length of the barrel. Traditionally, a clarinetist would have to change the entire barrel in order to change the length, and thus the pitch. Using the present interchangeable bore system, there are many varieties of length, and dimensions to choose from.

Through the use of different materials, processes and dimensions, better and more balanced tone color control is achieved. Better articulation and response also result as each material vibrates differently, giving many options to the player.

In accordance with the present invention, and with reference to FIGS. 1–3, the barrel system 20 includes a barrel body 28, which has an upper section 30 and a lower section 32, and a bore 34. The upper and lower sections 30 and 32 are similarly constructed to include internal threads 36 adjacent to an end thereof. The bore 34 has externally threaded ends 38, 40 which are threadedly connected to the internal threads 36 of the respective upper and lower sections 30 and 32. Thus, the bore 34 may be exchanged while maintaining the cork fit between the upper and lower sections 30 and 32 and their respective adjoining clarinet 26 components. The bore 34 also includes one or more identification rings or grooves 42.

The components of the interchangeable bore clarinet barrel system 20 may come in a variety of different materials and dimensions. For example, the bore 34 may be provided a number of different tapers, such as in the form of hourglass (both ends taper to the center of the barrel), flair (generally frustoconical in shape with some internal curvature), cylindrical (uniform diameter throughout the length of the bore, as shown in the drawings), reverse (strict frustoconical shape wherein the end that lines up with the mouthpiece 22 is larger than the end which lines up with the upper joint 24) or cone (strict frustoconical in shape wherein the end that lines up with the mouthpiece 22 is smaller than the end which lines up with the upper joint 24). In the embodiment of FIGS. 1–3, the reverse taper acts as a two-in-one taper as it may be inverted to produce the cone taper.

The identification ring or groove 42 is used to more easily recognize the large end of the bore 34 and the type of taper employed. By way of illustration, one ring may indicate a reverse or cone taper and is placed on the large end of the bore, two rings may indicate a cylindrical taper, three rings may indicate an hourglass taper, and four rings may indicate a flaired taper. Each barrel system 20 is also typically marked with the length and size of the bore 34, as the bore has various diameters, shapes and sizes to select from.

For example, referring to FIGS. 4 and 5, a variation of the interchangeable bore clarinet barrel assembly 20 is shown wherein the barrel assembly 20' is also comprised of a barrel having upper and lower sections 30', 32' and a bore 34'. The bore 34' has externally threaded ends 38', 40' which are threadedly connected to the internal threads 36' of the respective upper and lower sections 30', 32'. However, the shape and dimensions of these components differ from those of FIGS. 1–3. These variations impart different tone color, articulation, and response qualities and characteristics to the clarinet 26. The clarinetist is not limited to the size and shapes of the individual components of the interchangeable bore clarinet barrel assembly 20 as shown. Rather, these are merely illustrated as exemplary variations.

The tone color, articulation, and response qualities and characteristics can be further altered with the addition of tone rings 44 and 44'. As shown in FIGS. 7 and 8, the tone rings 44, 44' are typically disposed between the upper section 30, 30' and the bore 34, 34' and the lower section 38, 38' and the bore 34, 34'. The addition of the tone rings 44, 44' alters the vibration of the barrel assembly 20.

Figure 10:
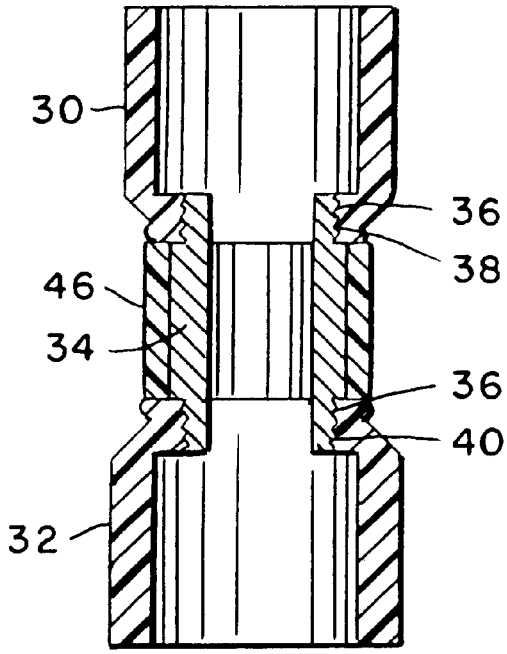
FIG. 10 is a cross-sectional view along line 10—10 of FIG. 9, illustrating the tone sleeve surrounding the bore.

The appearance, as well as the tone color, articulation, and response qualities can also be altered by placing a tone sleeve 46 over the bore 34. As shown in FIGS. 9 and 10, the tone sleeve 46 surrounds the bore 34 and is disposed between the respective upper and lower sections 30, 32.

Figure 11:
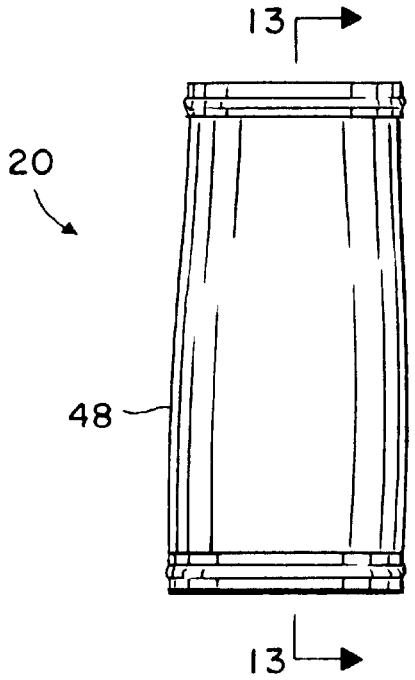
FIG. 11 is an elevational view of a third embodiment of the barrel system of the present invention.
Figure 12:
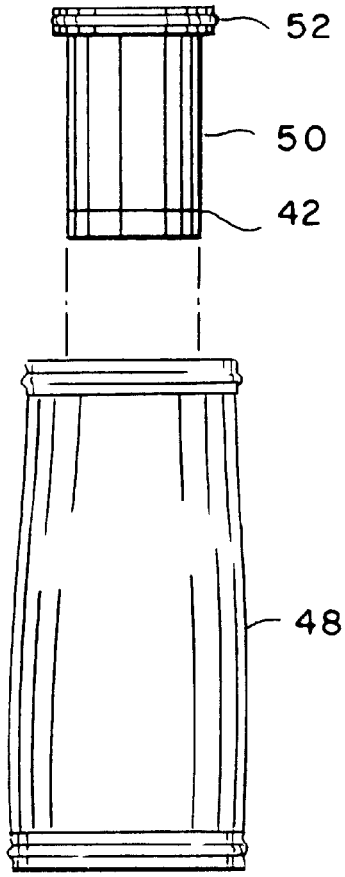
FIG. 12 is an exploded elevational view of the barrel system of FIG. 11, illustrating the relationship between a unitary barrel body and a removable bore.
Figure 13:
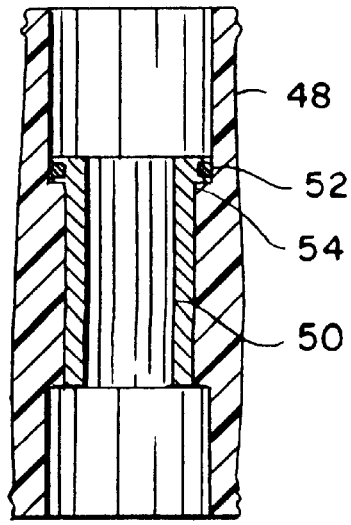
FIG. 13 is a sectional view taken generally along the line 13—13 of FIG. 11.

FIGS. 11–13, illustrate a more traditionally shaped barrel assembly 20 with many of the advantages of the above embodiments. In particular, an interchangeable bore clarinet system 20 is shown including a unitary barrel body housing 48 and a bore 50 having an upper flange 52. A frictional fit is formed by merely pressing the bore 50 into the body housing 48. The flange 52 contacts an inner shoulder 54 of the housing 48 to properly position the bore 50 therein. The bore 50 may include one or more identification ring indicia 42 and other marks to identify size and taper.

The bore 50 may be comprised of many different materials having a wide variety of shapes, sizes, dimensions and tapers. As in the previously described embodiments, the bore 50 of the barrel system 20 may be interchanged to produce different tone color, intonation, and response qualities. Cork fit between the barrel system 20 and the upper joint 24 of the clarinet 26 may also be maintained as changing the bore 50 only requires the removal of the unitary housing body 48 from the mouthpiece 22.

In another form of this embodiment not shown in the drawings, the bore 50 and barrel body housing 48 may be threadedly engaged to one another by screwing threads of the bore 50 into a threaded inner portion of the housing body 48.

In use, when the clarinetist is playing a clarinet 26 and wishes to change the characteristics of the clarinet 26, instead of removing the entire barrel and replacing it with another, the clarinetist will simply remove the bore 34, 50 by either unscrewing it or lifting it out from the barrel body 28, 48 and screw in or press a new bore into the barrel body 28. The clarinetist does not have to be concerned with carrying multiple barrels, instead carrying the smaller bores 34, 50 which are capable of many more interesting characteristics than the traditional barrels. Furthermore, by using the interchangeable bore barrel clarinet system the cork fit between the barrel body 28, 48 and the adjoining clarinet pieces remains in tact, preventing leaking which adversely affects the characteristics of the clarinet 26.

The transition to the new system is simple. The clarinetist will remove the old barrel from the clarinet 26 and replace it with the barrel body 28 and selected bore 34, 50. With reference to the embodiment of FIGS. 11–13, the clarinetist may even use his or her own barrel which can be modified by carving the interior surface of the barrel to use the interchangeable bore clarinet system 20.

Generally, the mouthpieces of clarinets are close to the same bore size. The bores of the various clarinets are different, however, not allowing a mouthpiece from one clarinet to be used on the body of another clarinet. With the interchangeable bore clarinet barrel system 20, the clarinetist may use the mouthpiece 22 of one clarinet 26 on the body of another by fastening the upper section 30 to a mouthpiece 22 of one clarinet 26 and attaching it to the remaining bore 34 and lower section 32 components of the barrel system 20 which are connected to the body of another clarinet.

The system may be used by the vision impaired or the clarinetist in the darkness of an orchestra pit by feeling the identification rings or grooves and other indicia 42, which indicate taper and size among other things. The clarinetist obtains the above advantages and flexibility while maintaining or even improving the response, articulation, tone color, and intonation of the clarinet 26.

Although the description set forth above describes in detail several embodiments of the invention for purposes of illustration, various modifications may be made to each without departing from the spirit and scope of the invention. Accordingly, the invention is not to be limited, except as by the appended claims.

What is claimed is:

1. An interchangeable bore clarinet barrel system for use in connection with a clarinet, comprising:

a barrel body attached at opposite ends to adjoining components of the clarinet, the barrel body including upper and lower sections attachable to respective adjoining components of the clarinet; and a bore removably attached to the barrel body and disposed between the upper and lower sections, wherein the bore and the barrel body cooperatively define an inner passageway extending the length of the barrel system, and wherein opposite ends of the bore are threadably received within the respective upper and lower sections of the barrel body.

2. The clarinet barrel system of claim 1, wherein the bore comprises a different material than the upper and lower sections of the barrel body.

3. The clarinet barrel system of claim 1, including a tone ring disposed between the bore and at least one of the upper and lower sections.

4. The clarinet barrel system of claim 1, including a tone sleeve surrounding the bore and disposed between the upper and lower sections of the barrel body.

5. The clarinet barrel system of claim 1, wherein the bore includes a cylindrical taper.

6. An interchangeable bore clarinet barrel system for use in connection with a clarinet, comprising:

a barrel body including upper and lower sections attachable to respective adjoining components of the clarinet; and a bore having a selected taper and removably attached to the upper and lower sections of the barrel body, wherein the barrel body and bore cooperatively define an inner passageway extending the length of the barrel system, the bore including identification indicia comprising at least one ring.

7. The clarinet barrel system of claim 6, wherein the bore comprises a different material than the upper and lower sections of the barrel body.

8. The clarinet barrel system of claim 6, including a tone ring disposed between the bore and at least one of the upper and lower sections of the barrel body.

9. The clarinet barrel system of claim 6, including a tone sleeve surrounding the bore and disposed between the upper and lower sections of the barrel body.

10. An interchangeable bore clarinet barrel system for use in connection with a clarinet, comprising:

a unitary barrel body attached at opposite ends to adjoining components of the clarinet; and a bore having a selected taper and removably disposed within the barrel body, wherein the bore and the barrel body cooperatively define an inner passageway extending the length of the barrel system, the bore including identification indicia comprising at least one ring.

11. The clarinet barrel system of claim 10, wherein the bore includes a radially outwardly extending flange that engages a shoulder within the housing, the flange and the shoulder cooperatively providing means for positioning the bore within the barrel body.

12. An interchangeable bore clarinet barrel system for use in connection with a clarinet, comprising:

a barrel body attached at opposite ends to adjoining components of the clarinet, the barrel body including upper and lower sections attachable to respective adjoining components of the clarinet;

a bore removably attached to the barrel body and disposed between the upper and lower sections, wherein the bore and the barrel body cooperatively define an inner passageway extending the length of the barrel system; and a tone sleeve surrounding the bore and disposed between the upper and lower sections of the barrel body.

13. The clarinet barrel system of claim 12, wherein the bore comprises a different material than the upper and lower sections of the barrel body.

14. An interchangeable bore clarinet barrel system for use in connection with a clarinet, comprising:

a barrel body attached at opposite ends to adjoining components of the clarinet, the barrel body comprising a unitary barrel body housing having opposite ends attachable to respective adjoining components of the clarinet; and a bore removably disposed within the barrel body, wherein the bore and the barrel body cooperatively define an inner passageway extending the length of the barrel system, and wherein the bore includes a radially outwardly extending flange that engages a shoulder within the housing, the flange and the shoulder cooperatively providing means for positioning the bore within the barrel body.

15. The clarinet barrel system of claim 14, wherein the bore is pressed into the housing and frictionally retained therein.

16. An interchangeable bore clarinet barrel system for use in connection with a clarinet, comprising:

a barrel body including upper and lower sections attachable to respective adjoining components of the clarinet;

a bore having a selected taper and removably attached to the upper and lower sections of the barrel body, wherein the barrel body and bore cooperatively define an inner passageway extending the length of the barrel system; and a tone sleeve surrounding the bore and disposed between the upper and lower sections of the barrel body.

17. An interchangeable bore clarinet barrel system for use in connection with a clarinet, comprising:

a unitary barrel body attached at opposite ends to adjoining components of the clarinet; and a bore having a selected taper and removably disposed within the housing, wherein the bore and the barrel body cooperatively define an inner passageway extending the length of the barrel system, the bore including a radially outwardly extending flange that engages a shoulder within the housing, the flange and the shoulder cooperatively providing means for positioning the bore within the barrel body.

* * * * *